United States Patent [19]

Edmonds

[11] 4,291,206

[45] Sep. 22, 1981

[54] CONTACT BREAKER ASSEMBLY

[75] Inventor: Richard D. Edmonds, Birmingham, England

[73] Assignee: Lucas Industries Limited, Birmingham, England

[21] Appl. No.: 34,542

[22] Filed: Apr. 30, 1979

[30] Foreign Application Priority Data

May 9, 1978 [GB] United Kingdom ..... 18389/78

[51] Int. Cl.[3] ..... H01H 19/00

[52] U.S. Cl. ..... 200/19 R; 200/291; 200/293

[58] Field of Search ..... 403/353, 154, 162, 163; 24/73 M, 73 RM, 73 S, 165, 241 SL; 200/19 R, 291, 293; 339/59 R, 221 R, 221 M; 308/237 A; 29/453

[56] References Cited

U.S. PATENT DOCUMENTS

| | | | |
|---|---|---|---|
| 1,988,595 | 1/1935 | Hiss | 29/453 |
| 2,592,130 | 4/1952 | Erb et al. | 29/453 |
| 2,774,430 | 12/1956 | Blazek | 74/531 X |
| 3,128,495 | 4/1964 | Tooth | 16/38 X |
| 3,558,838 | 1/1971 | Fry | 200/19 R |
| 4,068,342 | 1/1978 | Carrier | 16/38 X |

*Primary Examiner*—J. V. Truhe
*Assistant Examiner*—Morris Ginsburg
*Attorney, Agent, or Firm*—Holman & Stern

[57] ABSTRACT

A contact breaker assembly including a pivot post, a fixed electrical contact, a heel assembly pivotally mounted on said post and a movable contact carried by said heel assembly and movable into and out of engagement with said fixed contact by pivotal movement of the heel assembly about said post. The heel assembly includes a member having extending therein a bore within which a region of said post is received pivotally to mount the heel assembly on said post. The region of said post is formed with a circumferentially extending recess, and the wall of said bore has a radially inwardly extending projection which is resiliently engaged in said recess. The co-operation of the projection and the recess limits the freedom of axial movement of the heel assembly relative to the post at least in one axial direction.

4 Claims, 5 Drawing Figures

CONTACT BREAKER ASSEMBLY

BRIEF SUMMARY OF THE INVENTION

This invention relates to a contact breaker assembly, for use in an ignition distributor system, of the kind wherein a heel assembly carrying the movable contact of the contact breaker assembly is pivotally mounted on a pivot post, is spring urged to pivot about the post in one direction to engage the movable contact with a fixed contact of the assembly and is pivotable in the opposite direction about the post in use by the action of a rotating cam which engages the heel assembly.

It is known for the post to be part of the unitary contact breaker assembly for installation as a pre-built unit in an ignition distributor or for the post to be defined by a part separate from the contact breaker assembly and forming part of the distributor and onto which the contact breaker assembly is assembled.

It is desirable to ensure that the heel assembly has only a limited freedom of movement relative to the post in an axial direction in use. In the past this desideratum has been achieved by ensuring that the post is long enough to project through the heel assembly and providing the projecting part of the post with a circlip which limits axial movement of the heel assembly relative to the position in one direction, the movement being limited in the other direction by abutment of the heel assembly with a support plate of the contact breaker assembly. This solution to the problem of axial movement is expensive and time consuming to assemble. An alternative proposal has been to form the projecting end of the post with a head either after assembly of the heel assembly to the post or prior to assembly if the part of the heel assembly which engages the post is resilient enough to 'snap-over' the head. Both of these solutions are disadvantageous in that a post longer than the heel assembly axial dimension is required and this is expensive in terms of the post material which may be brass and also in tooling and operation time necessary to form the head after assembly to the post of the heel assembly. It is an object of the present invention to provide a contact breaker assembly wherein the freedom of axial movement of the heel assembly relative to the pivot post is limited but wherein the disadvantages of the aforementioned proposals are minimised.

A contact breaker assembly according to the invention includes a pivot post, a fixed electrical contact, a heel assembly pivotally mounted on said post and a movable contact carried by said heel assembly and movable into and out of engagement with said fixed contact by pivotal movement of the heel assembly about said post, said heel assembly including a member having extending therein a bore within which a region of said post is received pivotally to mounted the heel assembly on said post, said region of said post being formed with a circumferentially extending recess, and the wall of said bore carrying a radially inwardly extending projection which is resiliently engaged in said recess, the co-operation of the projection and the recess limiting the freedom of axial movement of the heel assembly relative to the post at least in one axial direction.

Preferably the wall of the bore carries a second similar projection also resiliently engaged in said recess.

Conveniently said projection is diametrically opposite the first mentioned projection.

BRIEF DESCRIPTION OF THE SEVERAL VIEWS OF THE DRAWING

One example of the invention is illustrated in the accompanying drawings wherein.

DETAILED DESCRIPTION

Figure 1:
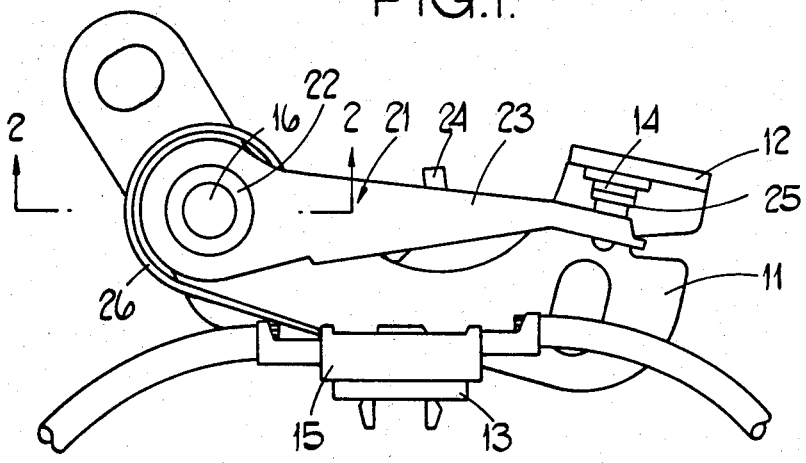
FIG. 1 is a plan view of a unitary contact breaker assembly.
Figure 2:
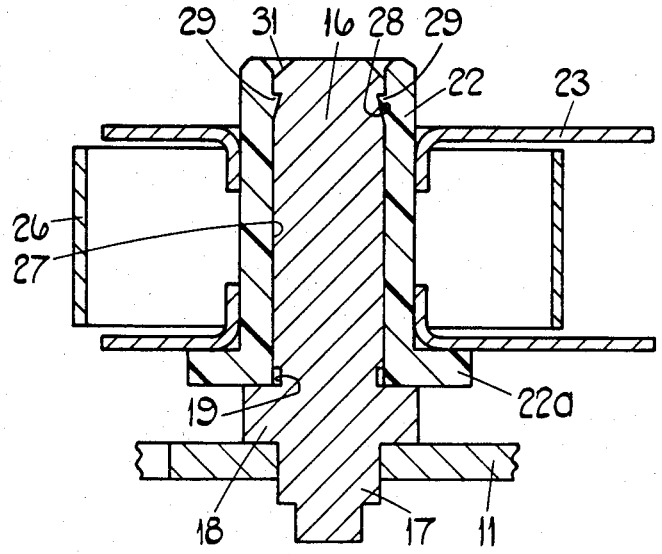
FIG. 2 is a sectional view on the line II—II in FIG. 1 to an enlarged scale.
Figure 3:
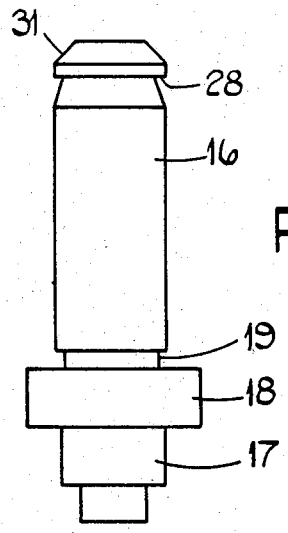
FIG. 3 is a side elevational view of the pivot post seen in section in FIG. 2.
Figure 4:
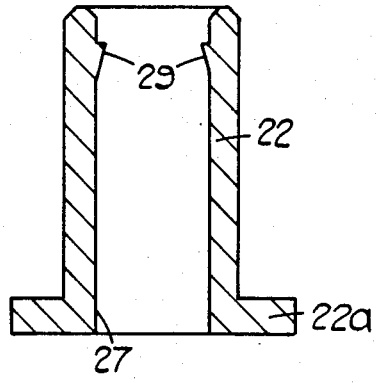
FIG. 4 is a sectional view of a bush of the heel assembly seen in FIGS. 1 and 2.
Figure 5:
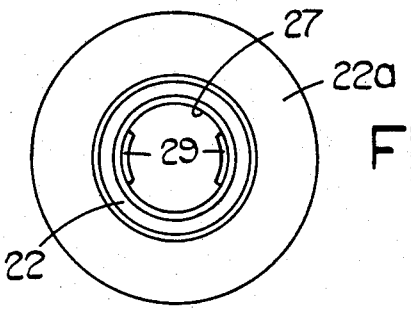
FIG. 5 is an end view of the bush shown in FIG. 4.

Referring to the drawings, the contact breaker assembly comprises a generally planar arcuate, metal support plate 11 having first and second integral upstanding lugs 12, 13. The lug 12 carries a fixed electrical contact 14 of the contact breaker assembly and the lug 13 carries a combined spring anchor and terminal arrangement 15 of the assembly. Upstanding from the plate 11 at its end remote from the lug 12 is a brass pivot post 16 of circular cross-section. The post 16 is secured to the plate 11 at right angles thereto by means of a spigot 17 integral with the post 16 and passing as a drive fit through an aperture in the plate 11. The spigot 17 projects from the lower surface of the plate 11 to provide a pivotal interconnection between the unitary contact breaker assembly and a mounting plate of an ignition distributor in which the contact breaker assembly is utilised. The spigot 17 projects from a flange portion 18 of the pivot post 16 the outer diameter of the flange portion 18 being in excess of the outer diameter of the remainder of the post 16. One face of the flange portion 18 abuts the upper surface of the plate 11 and may be welded thereto in order to further secure the post 16 to the plate 11. At the junction of the flange portion 18 and the remainder of the post 16 there is provided a shallow groove 19 which acts as a lubricant reservoir in use, and which avoids the presence of a curved radius at the junction of the remainder of the post 16 and the flange portion 18.

A heel assembly 21 is pivotally supported on the post 16 and comprises a moulded synthetic resin bush 22 having a radially outwardly extending circumferential flange *22a* at its lower end. Secured to the bush 22 is an elongate metal shell 23 carrying, intermediate its ends, a moulded synthetic resin cam follower 24. At its end remote from the bush 22 the shell 23 carries a movable electrical contact 25. Secured to the shell 23 and in electrical connection therewith is one end of an elongate curved metal leaf spring 26 the other end of which is received by the combined spring anchorage and terminal arrangement 15. The arrangement 15 acts as a reaction point for the spring 26, and the spring 26 urges the heel assembly 21 to pivot about the post 16 to engage the movable contact 25 with the fixed contact 14. In use, the cam follower 24 co-operates with a rotating cam in the ignition distributor utilising the contact breaker assembly, the action of the rotating cam being to periodically pivot the heel assembly 21 against the action of the spring 26 to displace the movable contact 25 from the fixed contact 14.

The heel assembly 21 is pivotally mounted on the post 16 by way of the moulded synthetic resin bush 22, the post 16 being received in the bore 27 of the bush 22. The axial length of the post 16 between its free end and the upper surface of the flange portion 18 is equal to the axial length of the bush 22 between the lower face of the flange 22*a* and the free end of the bush. Thus when the bush 22 is fully engaged on the post 16 the lower surface of the flange 22*a* abuts the upper surface of the flange portion 18, and the free end of the bush 22 is substantially flush with the free end of the post 16.

Adjacent its free end the post 16 is formed with a circumferentially extending recess 28, generally of V-shaped cross-section. The wall of the recess 28 adjacent the free end of the post 16 extends at right angles to the axis of the post, and the other wall of the recess 28 is inclined at an angle to the axis of the post 16. Integral with the bush 22 and protruding radially inwardly from the wall of the bore 27 are a pair of diametrically opposed projections 29. Each of the projections 29 extends part way around the circumference of the bore 27, and each has a cross-sectional shape corresponding to the cross-sectional shape of the recess 28. Since the diameters of the post 16 and the bore 27 are such that the bush 22 is a close, but freely rotatable fit on the post 16, then during insertion of the post 16 into the bore 27 the projections 29 constitute an impediment to full insertion of the post 16. However, the material of the bush 22 is sufficiently resilient to permit resilient deformation of the bush in the region of the projections 29 as the post 16 co-acts with the inclined surfaces of the projections 29. Thus the application of a relatively small force during assembly of the bush 22 onto the post 16 ensures that the projections 29 engage as a snap-fit in the circumferentially extending recess 28. The free end of the post 16 is chamfered at 31 to facilitate inter-engagement of the post 16 and the bush 22. It will be recognised that when the projections 29 are resiliently received within the recess 28 the perpendicularly extending walls of the recesses 29 engage the corresponding wall of the recess 28 strongly to resist withdrawal of the bush 22 from the post 16. Thus the coaction of the projections 29 and the recess 28 limit the freedom of axial movement of the bush 22 relative to the post 16 in the direction of withdrawal of the bush 22 from the post 16. Abutment of the flange 22*a* of the bush 22 with the flanged portion 18 of the post 16 limits the freedom of axial movement of the bush 22 and therefore the heel assembly 21 relative to the post 16 in the opposite axial direction, and of course the coaction of the inclined walls of the projections 29 with the inclined wall of the recess 28 also provides limitation of axial movement in this direction.

In order to ensure that the bush 22, and therefore the heel assembly 21 is freely rotatable on the post 16 the axial positioning of the recess 28 and projections 29 is such that the flange 22*a* does not bind tightly against the flange portion 18. Moreover, although no clearance is shown between the projections 29 and the recess 28 there will preferably be a clearance sufficient to ensure freedom of rotational movement of the bush 22 on the post 16.

It will be recognised that the axial length of the bush 22 will be chosen having regard to the bearing length necessary to achieve adequate support of the heel assembly 21. By virtue of the projections 29 and recess 28 the length of the post can be reduced to a minimum consistent with achieving the desired bearing length, and thus the usage of material in producing post 16 is optimised.

I claim:

1. A contact breaker assembly including a pivot post, a fixed electrical contact, a heel assembly pivotally mounted on said post and a movable contact carried by said heel assembly and movable into and out of engagement with said fixed contact by pivotal movement of the heel assembly about said post, said heel assembly including a member having extending therein a bore within which a part of said post is received to pivotally mount the heel assembly on said post, said part of said post being formed with a circumferentially extending recess, and a radially inwardly extending projection on the wall of said bore which is resiliently engaged in said recess, said projection and recess co-operating to limit axial movement of the heel assembly relative to the post at least in one axial direction.

2. A contact breaker assembly as claimed in claim 1 and further comprising a second projection similar to said first mentioned projection on the wall of said bore also resiliently engaged in said recess.

3. A contact breaker assembly as claimed in claim 2 wherein said projections are diametrically opposite each other.

4. A contact breaker assembly as claimed in claim 3 wherein said recess is substantially V-shaped in cross-section formed by one wall of said recess extending substantially perpendicular to the longitudinal axis of said post and the other wall of said recess being inclined at an angle with respect to said axis, each said projection having a cross-sectional configuration which conforms to said V-shaped recess.

* * * * *